US005348324A

United States Patent [19]

Trotta

[11] Patent Number: 5,348,324

[45] Date of Patent: Sep. 20, 1994

[54] TRANSPORTABLE COMPONENT STAND

[75] Inventor: Frank A. Trotta, Maplewood, N.J.

[73] Assignee: Electronic Voting Systems, Inc., New York, N.Y.

[21] Appl. No.: 957,210

[22] Filed: Oct. 6, 1992

Related U.S. Application Data

[63] Continuation-in-part of Ser. No. 782,744, Oct. 17, 1991, Pat. No. 5,190,302, which is a continuation of Ser. No. 518,164, May 3, 1990, abandoned.

[51] Int. Cl.[5] ..... B62B 3/02

[52] U.S. Cl. ..... 280/35; 49/254; 108/144; 211/207; 248/125; 248/129; 248/917; 248/919; 248/921; 280/47.35; 312/139.1; 312/323

[58] Field of Search ..... 280/35, 47.18, 47.34, 280/47.35; 248/129, 125, 917, 919, 924; 108/144; 211/207; 312/22, 139.1, 323, 331; 49/254

[56] References Cited

U.S. PATENT DOCUMENTS

| | | | |
|---|---|---|---|
| 282,375 | 1/1886 | Dolson . | |
| 2,319,613 | 5/1943 | Lichtstern et al. | 312/2 |
| 2,804,979 | 9/1957 | Lassiter | 280/35 |
| 2,856,252 | 10/1958 | Herring | 312/323 |
| 3,170,710 | 2/1965 | Rachman . | |
| 3,181,785 | 5/1965 | Laws et al. . | |
| 3,286,918 | 11/1966 | Coyle . | |
| 3,315,621 | 4/1967 | Szymber . | |
| 3,333,766 | 8/1967 | Crossland et al. . | |
| 3,389,947 | 6/1968 | Kelley et al. . | |
| 3,620,587 | 11/1971 | Ahmann . | |
| 3,652,012 | 3/1972 | Harris et al. . | |
| 3,807,574 | 4/1974 | Lanza | 211/207 |
| 3,904,853 | 9/1975 | Shoup et al. | 235/51 |
| 4,377,367 | 3/1983 | Smith . | |
| 4,440,457 | 4/1984 | Fogelman et al. . | |
| 4,445,731 | 5/1984 | Ahmann . | |
| 4,451,728 | 5/1984 | McKay et al. . | |
| 4,510,378 | 4/1985 | Dolson . | |
| 4,603,925 | 8/1986 | Cuevas-Cumming | 49/254 |
| 4,624,510 | 11/1986 | Jedziniak | 248/917 |
| 4,690,417 | 9/1987 | Betts et al. . | |
| 4,718,741 | 1/1988 | Nichoalds . | |
| 4,827,439 | 5/1989 | Licht | 312/323 |
| 4,848,710 | 7/1989 | Newman . | |
| 5,174,223 | 12/1992 | Nagy et al. | 108/144 |
| 5,190,302 | 3/1993 | Trotta | 280/35 |

FOREIGN PATENT DOCUMENTS

| | | |
|---|---|---|
| 561940 | 11/1957 | Belgium . |
| 0321137 | 6/1989 | European Pat. Off. . |
| 2902803 | 7/1980 | Fed. Rep. of Germany . |
| 3619481 | 12/1987 | Fed. Rep. of Germany . |
| 8905788 | 7/1989 | Fed. Rep. of Germany . |
| 2557438 | 7/1985 | France . |
| 2567378 | 1/1986 | France . |
| 2613514 | 10/1988 | France . |
| 2171597 | 9/1986 | United Kingdom . |

*Primary Examiner*—Eric Culbreth

*Attorney, Agent, or Firm*—Hedman, Gibson & Costigan

[57] ABSTRACT

A transportable component stand having interactive upper and lower frame members wherein components can be raised and lowered by an electromechanical crank including an electric motor and threaded shaft, which raises and lowers the upper frame member on the lower frame member. Closable front and rear covers are also included. The stand allows a user to transport, store and use the components in a variety of environments.

17 Claims, 14 Drawing Sheets

TRANSPORTABLE COMPONENT STAND

CROSS REFERENCE TO RELATED APPLICATIONS

This is a continuation-in-part of U.S. patent application Ser. No. 07/782,744, filed Oct. 17, 1991, now allowed, which is a continuation of U.S. patent application Ser. No. 07/518,164, filed May 3, 1990, now abandoned.

FIELD OF THE INVENTION

The present invention relates to a transportable device for supporting components which can be moved to a specific location for use of said components.

BACKGROUND OF THE INVENTION

The public has come to rely on the use of various electronic components for innumerable functions in society. However, mobility and physical set-up of the components have been a problem when the components are cumbersome and need special supports to be properly positioned for various uses by various persons.

Therefore, the objects of the present invention are to provide means for storage, transport and use of electronic components which is easily movable and which can be adjusted for various uses by various persons.

SUMMARY OF THE INVENTION

The objects of the present invention are realized by a transportable component stand comprising means for mounting one or more components for user interaction, means for selectively varying component height using interactive upper and lower frame members and means for physical movement of the device.

The means for mounting the components include a closable component module, in which the components are mounted. The module can be made removable from the transport device for storage and or use of the components apart from the transportable stand. The component module, however, as contemplated herein, is attached to the stand for use of the mounted components while on the transportable stand, allowing the components to be moved to a designated location and used without additional support means.

The means for mounting the components may also include means for tilting one or more of the components to the angle best suited to the specific user. A variety of means to adjust the angle of components, especially a computer monitor, are known in the art. Specifically contemplated herein are a chassis bracket having pivot posts at the component balance point or a swivel base which pivots on a vertical plane.

Means for selectively varying component height allows adjustment of the components on the transportable stand from a low position to a high position enabling the stand to function for a variety of different uses. The means for varying component height associated with the stand comprises a crank or jack or ratchet-type elevating means wherein the height of the components can be adjusted without removal of the components themselves. The preferred means for varying component height however is an electromechanical crank assembly including an electric motor and a screw member extending from the upper frame member, said screw member being engaged by a flange or nut associated with the lower frame member.

The electric motor and the components preferably have a battery back-up, for memory as well as to run the components in the event of a power outage, located in a compartment on the lower frame member. Alternatively, the compartment on the lower frame member can have a slot to act as a ballot box in the event of a power failure.

The upper and lower frame members are preferably formed of a rigid steel assembly, each with two vertical side members that interact to provide support and guidance to the upper frame member during raising and lowering. Specifically, it is preferred that the lower frame member have vertical side members which accept the vertical side members of the upper frame member. Raising and lowering of the upper frame member is facilitated by slide bearings between the vertical side members when in an inserted position.

Means for physical movement is also included, i.e. wheels, casters, rollers, etc., or combinations thereof. The means are enhanced by one or more handles to help maneuver the transportable component stand.

The means for physical movement allows easy transportation of the stand to a designated location for use of the components. This feature is particularly important when the components supported in the stand can include electronic voting means, children's educational computers, information computers and the like, which are relocated depending on need.

Storage compartments are incorporated into the stand as desired for specific uses. For instance, use as a voting booth may include a compartment for concealing enclosure hardware, i.e. a curtain support structure, as well as a compartment for storing the privacy curtains. Also, a cover for the back of the component compartment, optionally including a locking means, may be desirable to limit access to the back of the components and to consolidate the power needs of the components into a single power supply cord. Similarly, a locking cover for the front of the components can be included to prohibit unauthorized use.

The front cover of the component compartment preferably comprises a pivotable panel which can assume three positions, namely, closed and/or locked over the components, open and horizontally slid rearwardly into a space above the components or open and tilted back at a slight angle above the components for use as an instruction or ballot board. A lockable disc drive is also contemplated for security.

DESCRIPTION OF THE DRAWINGS

The following figures, in which like reference characters indicate like parts, merely illustrate an embodiment of the present invention and are not intended to limit the invention in any manner whatsoever.

DESCRIPTION OF THE PREFERRED EMBODIMENT

Figure 1:
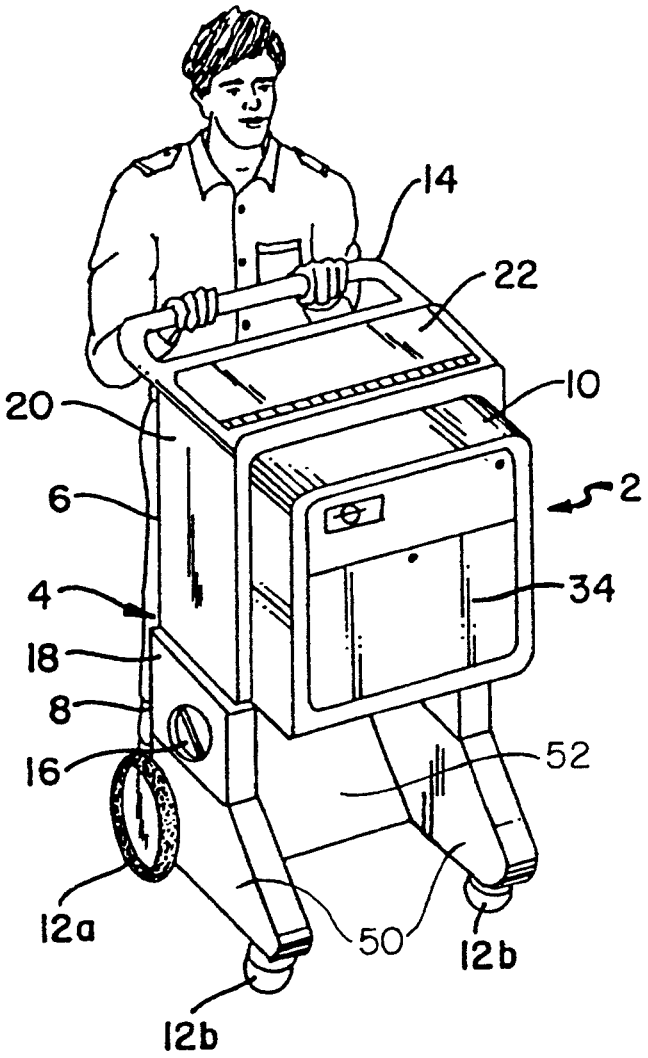
FIG. 1 is a perspective view of the transportable stand of the present invention being moved with the components in the low position.

As shown in the FIGURES, and specifically FIG. 1, the transportable component stand 2 of the present invention is comprised of a frame 4 including an upper frame member 6 and a lower frame member 8. The components are shown located within a component module 10 which is attached to the lower frame member 6. Wheels 12 are attached to the lower frame member 8 for mobility and handle means 14 are included on the upper frame member 6 to facilitate maneuverability. An elevating means, such as a crank 16, is located on one of the sides of the lower frame member 8 to raise and lower the upper frame member 6, including the component module 10, to the desired height.

The frame 4 can be made of any suitable materials including metals, alloys, wood, plastic, combinations of these, or other materials able to achieve the intended use, with a metal and specifically a rigid steel being most preferred.

For transporting the stand 2, as shown in FIG. 1, it is preferred that the upper frame member 6 is in the low position to lower the center of gravity and avoid toppling. Although a different number of wheels can be used, the preferred stand 2 has four wheels 12*a* and 12*b* on the bottom of the lower frame member 8 to maximize maneuverability and stability. As shown in the FIGURES, the back wheels 12*a* are of larger size, extend rearwardly out from the back plane of the unit 2, to facilitate traversing stepped changes in elevation and are fixed laterally. The front wheels 12*b* are preferably swivel or caster type to facilitate turning. This wheel configuration, although not essential to the invention, has been found to achieve good results for mobility, maneuverability and stability.

Stability is also improved by the placement of the wheels at the corners of a square, the size of which is dependent on the intended use. It has been found that, for use with a computer system including monitor, drive and keyboard, a distance of about 24" between the wheels on any side is appropriate to combine stability and efficient use of space.

Once the stand 2 is positioned into place, the wheels 12 are locked or fixed to avoid inadvertent movement of the stand. Alternatives may include retractable wheels to allow the stand 2 to rest on the lower frame member 8 or extensions thereof, i.e. posts, attached to the lower member 8.

The lower frame member 8 is recessed between the front wheels 12*b* to allow a wheelchair, or the user's legs when seated on a standard chair, to rest under the component module 10 and place the user within reach of the components. The tops of the sides 18 of the lower frame member 8 have female openings substantially the size and shape of the bottom of the sides 20 of the upper frame member 6, adapted to securely receive the bottom of the male sides 20 in inserted relationship. Thus, the upper frame member 6 is engaged and securely held by the lower frame member 8. In the preferred embodiment slide bearings are used between the contacting upper and lower frame side members 20 and 18 to facilitate raising and lowering of the upper frame member 6 on the lower frame member 8. Upper slide bearings 92*a* are placed at the top of the lower frame member sides 18 and lower slide bearings 92*b* are placed on the bottom of the upper frame member sides 20 (see FIGS. 10A–10D).

A crank 16 as shown in FIG. 1 or similar means is located on the lower frame member 8 which internally cooperates with the inserted portion of the side 20 of the upper frame member 6 to raise or lower the upper frame member 6 on the lower frame member 8. The crank 16 need only be on one side of the lower frame member 8 with means to level and secure the upper frame member 6 cooperating with the other side 20, by means of cooperating gears.

Figure 8:
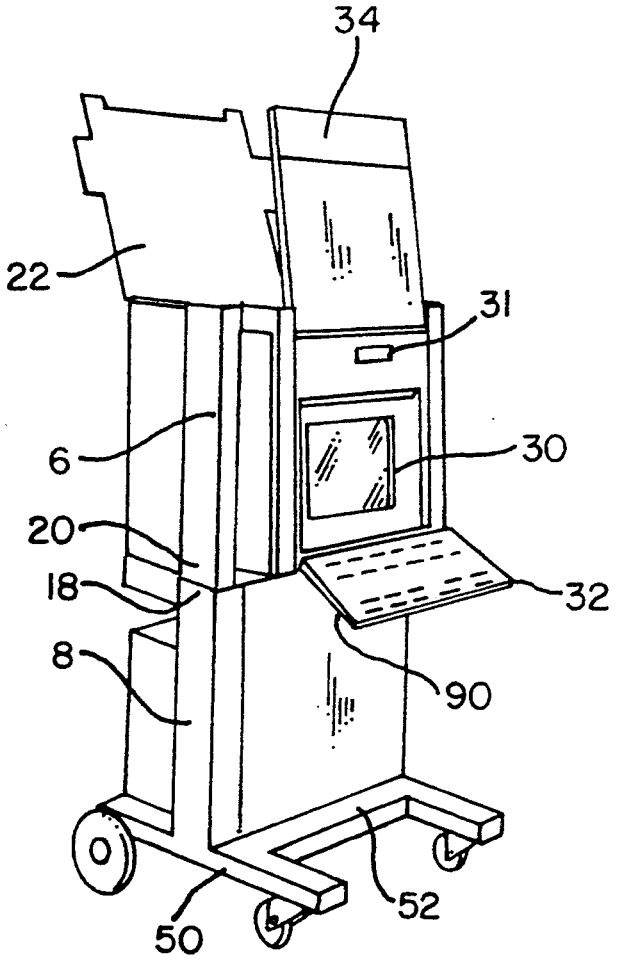
FIG. 8 is a perspective view of the front of the preferred embodiment of the component stand.
Figure 9:
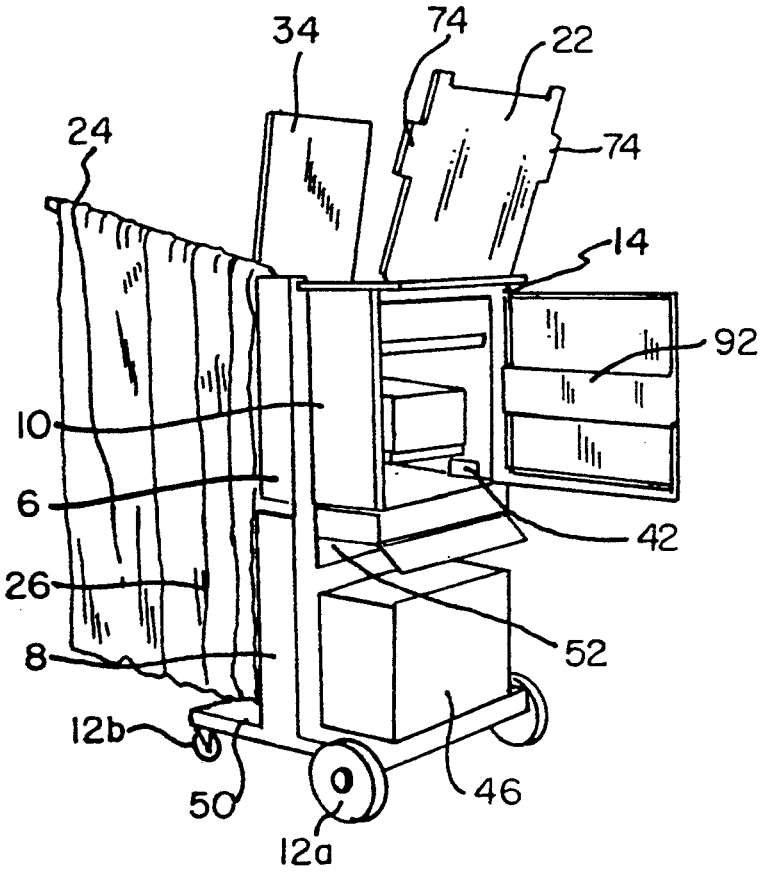
FIG. 9 is a perspective view of the back of the preferred embodiment of the component stand shown in FIG. 8.
Figure 10B:
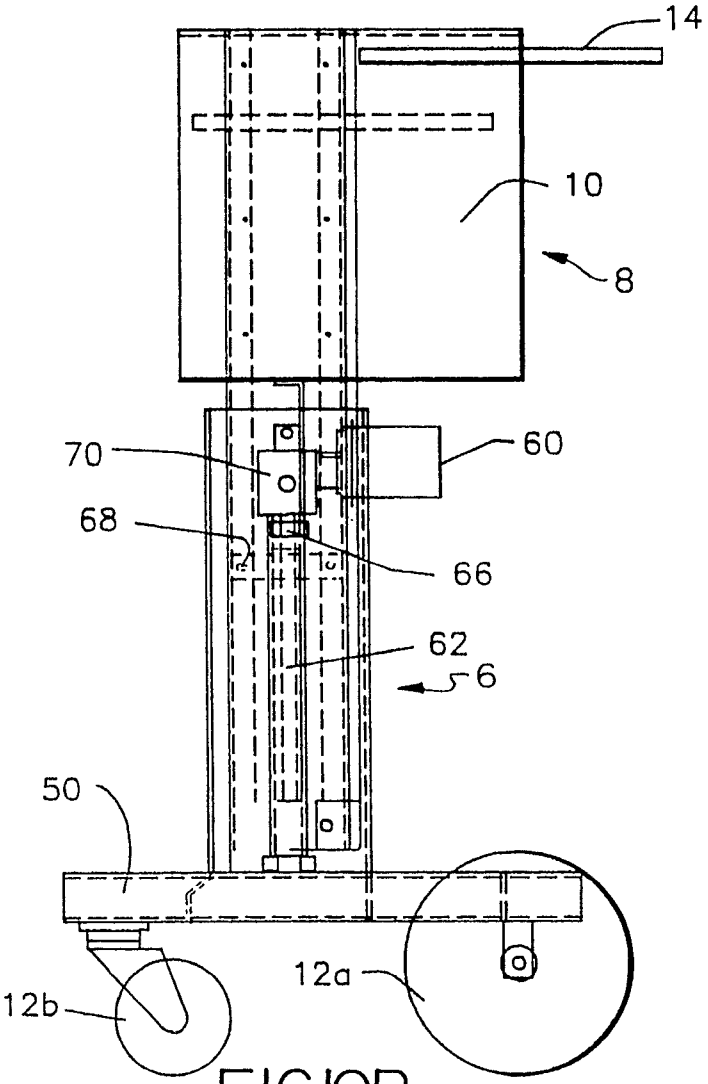
FIGS. 10A and 10B are schematic front and side views, respectively, of the preferred embodiment in its lowered position illustrating the motorized crank assembly to vary component height.
Figure 10A:
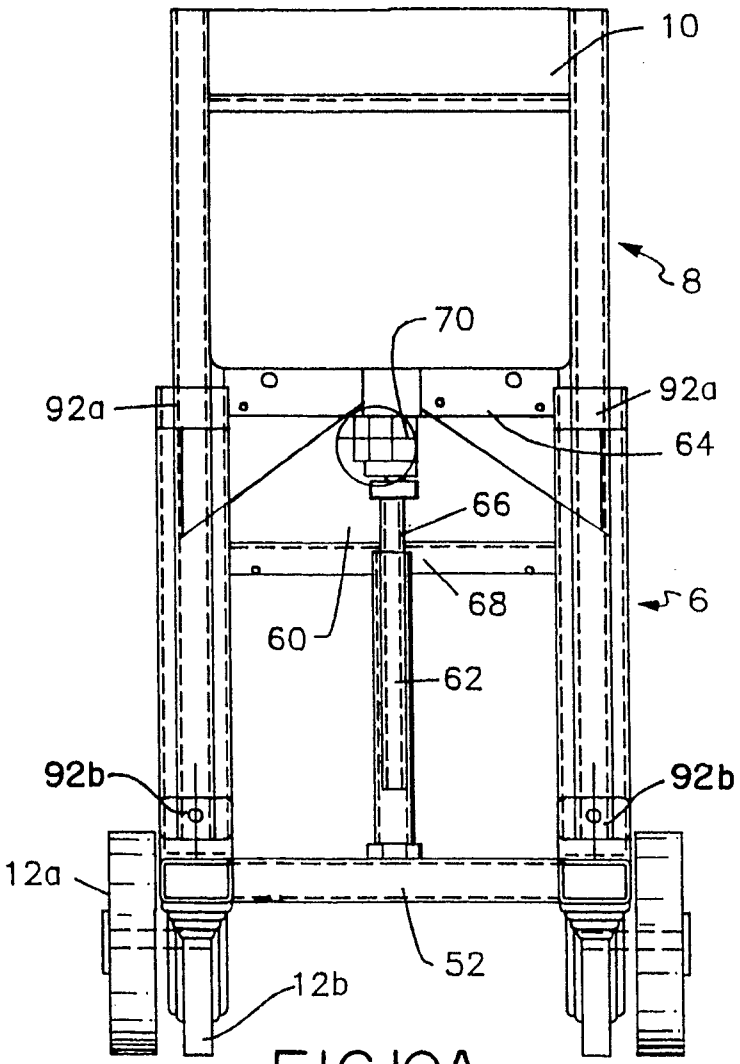
Figure 10D:
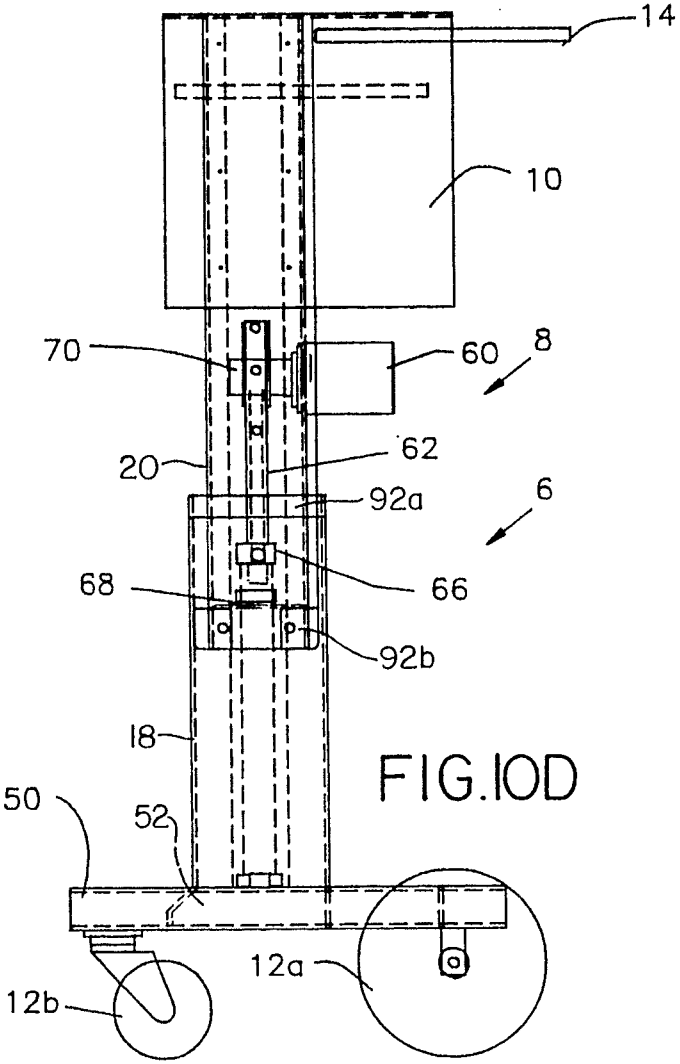
FIGS. 10C and 10D are schematic front and side views, respectively, of the preferred embodiment in its raised position.
Figure 10C:
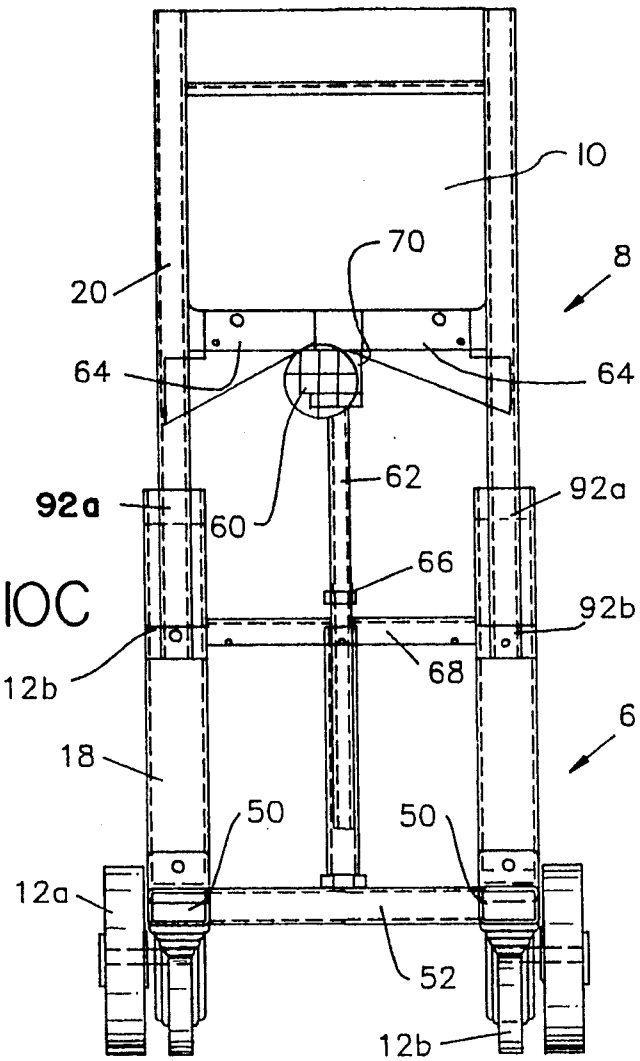

In the embodiment of FIGS. 8 and 9 the crank means is operated by an electric motor 60 located beneath the component module 10 on the upper frame member 6 (see FIGS. 10A–10D). Preferably, the electric motor 60 is a 115 Volt AC, 1700 rpm motor with a 20:1 speed reduction gear box 70. A threaded shaft 62 terminating at a cross bar 64 of the upper frame member 6, and extending downwardly therefrom, engages a linear ball screw/nut activator 66 with a travel of 0.187 inch per revolution. The activator 66 rests on a cross bar 68 of the lower frame member 8. The electric motor 60 rotates the threaded shaft 62 on actuator 66 to raise or lower the upper frame member 6 on the lower frame member 8 over a range of 14". Preferably, a three position switch or key switch located on the front of the stand, or in a lockable compartment for security, is used to activate the motor 60 in forward or reverse to raise or lower the upper frame member 6 (see FIGS. 10A–10D).

The upper frame member 6, which supports the component module 10, is enclosed on its sides in the present embodiment. The lower end of the sides 20 of the upper frame member 6 fit into the open sides 18 of the lower frame member 8 (described above). The front and back of the upper frame member 6, and/or component module 10, are openable with means to accept and mount the components in the component module 10 on the upper frame member 6. A handle 14 is included on the back of the frame 4 at the top of the upper frame member 6 to improve maneuverability during transportation. Of course, the handle 14 can be any handle means including two protruding handles, one on each side of the back of the frame 4 or protruding from side members 20, rather than the single handle 14 shown.

Figure 3:
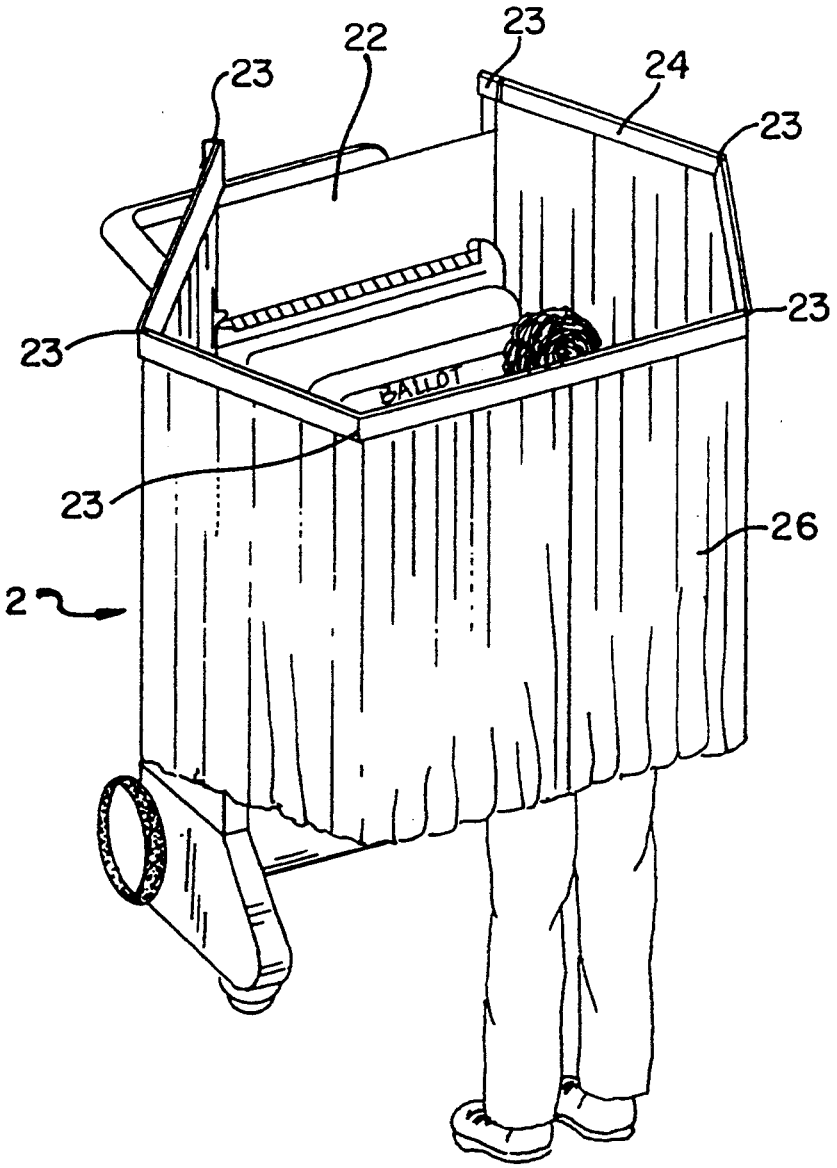
FIG. 3 is a perspective view of the stand used as a voting enclosure in the high position.

The top of the upper frame member 6 preferably includes a top storage compartment closed by a hinged door 22. To permit use of the stand 2 for many functions, the top storage compartment may house a curtain support structure 24 for supporting a privacy curtain 26, and/or the curtain 26, adapted to enclose the component module 10 during use as a voting booth or at other times when privacy is desired (see FIG. 3).

The curtain support structure 24 can be made of any material capable of supporting the privacy curtain 26, such as a metal or high strength plastic, or a combination of these. Hinges 23 are provided in the structure 24 to allow folding of the structure 24 into the top storage compartment and opening of the "doors" of the privacy curtain for entrance and exit. The hinges 23 are preferably stop hinges which limit the pivot motion of the sections of the structure.

In the alternative embodiment shown in FIG. 9, the hinged door 22 most preferably has extensions 74 on the sides thereof to serve as covers for open, hollow side members 20 of the upper frame member 6. The side members 20 are preferably hollow to provide for storage of a curtain support bar 24, shown in FIG. 11, therein. In this embodiment the curtain 26 is stored in the top storage compartment under hinged door 22.

Figure 11:
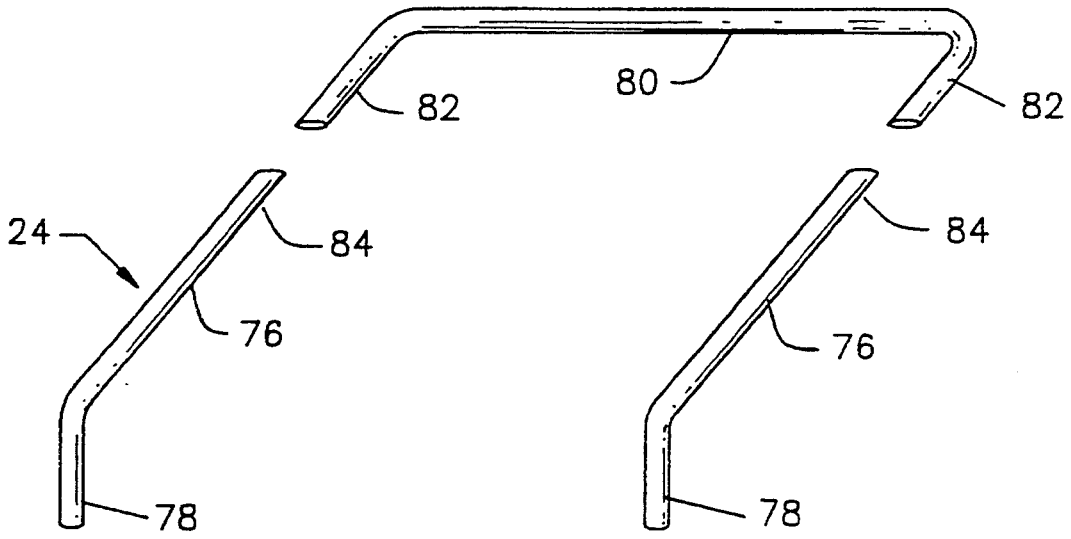
FIG. 11 is an exploded view of the curtain support assembly.

The preferred curtain support bar 24 comprises a three part bar of tubular steel, as shown in FIG. 11. The side bars 76 have thinner male ends 78 which engage female holes (not shown) on the upper frame member 6. The center bar 80 has means 82 to engage the opposite ends 84 of the side bars 76 also preferably comprising a male end which is inserted into a female opening on the member being engaged.

The curtain 26 has a loop at the top for threading with the curtain support bar 24. Preferably, the curtain 26 is a two piece curtain which slides across the bar 24, with the two pieces meeting in the middle of the center bar 80 when closed.

Figure 7:
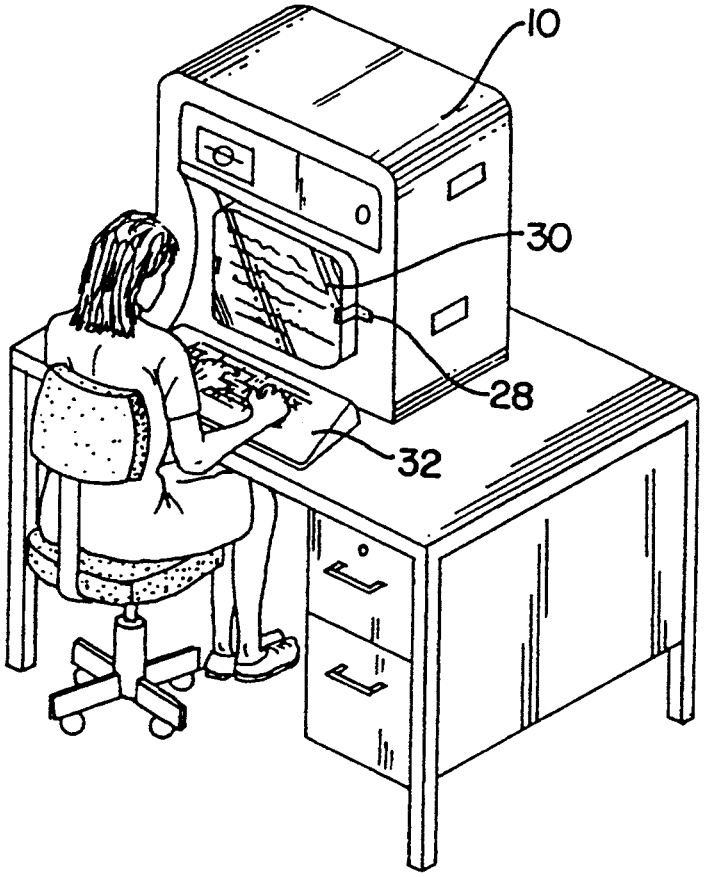
FIG. 7 is a perspective view of the component module removed from the transportable stand being used at a desk.

Generally, the desired components are contemplated to include a touch input screen or monitor 30, a computer drive system 31 and possibly a keyboard 32 for user interaction. Other possible components may include a sound or video system. Preferably, however, the components are placed in a component module 10 which is engaged by the upper frame member 6 by engagement means including bolts, hooks, shelves or welds. The component module 10 containing the components may be removable from the frame 4 for use of the component system apart from the transportable stand 2, as shown in FIG. 7, if desired. Notwithstanding, the component module 10 provides an enclosure for the components enhancing security and storability.

Figure 13B:
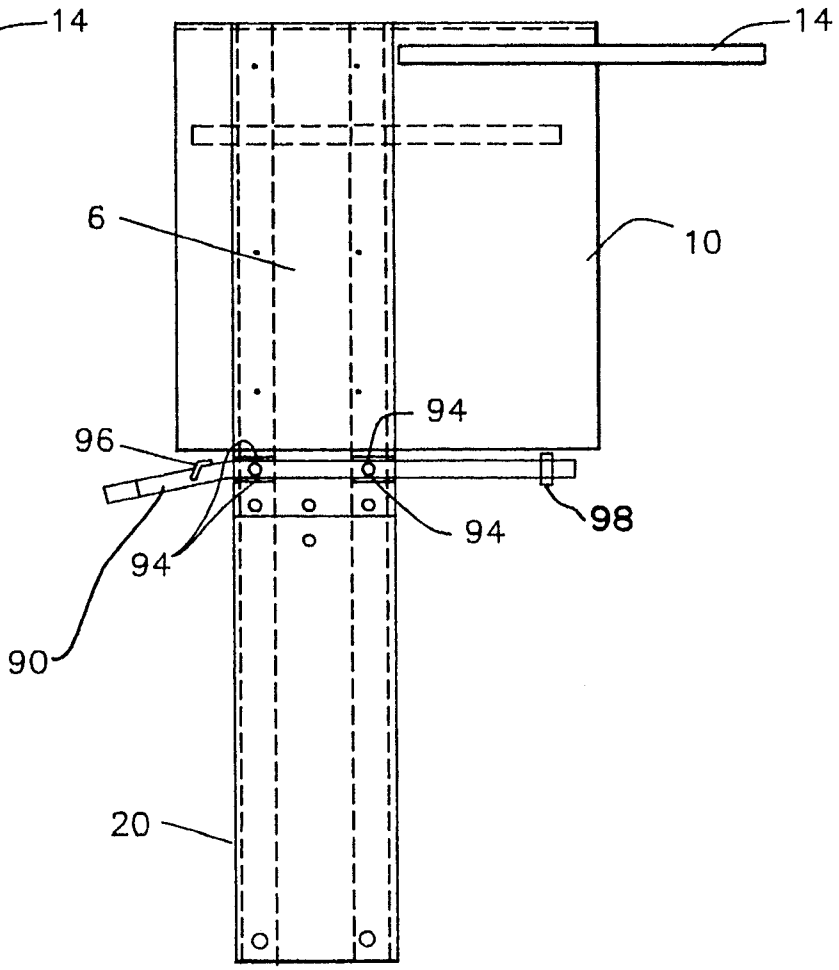
FIGS. 13A and 13B are side views of the upper frame member with the keyboard support bracket in its extended and retracted positions, respectively.
Figure 13A:
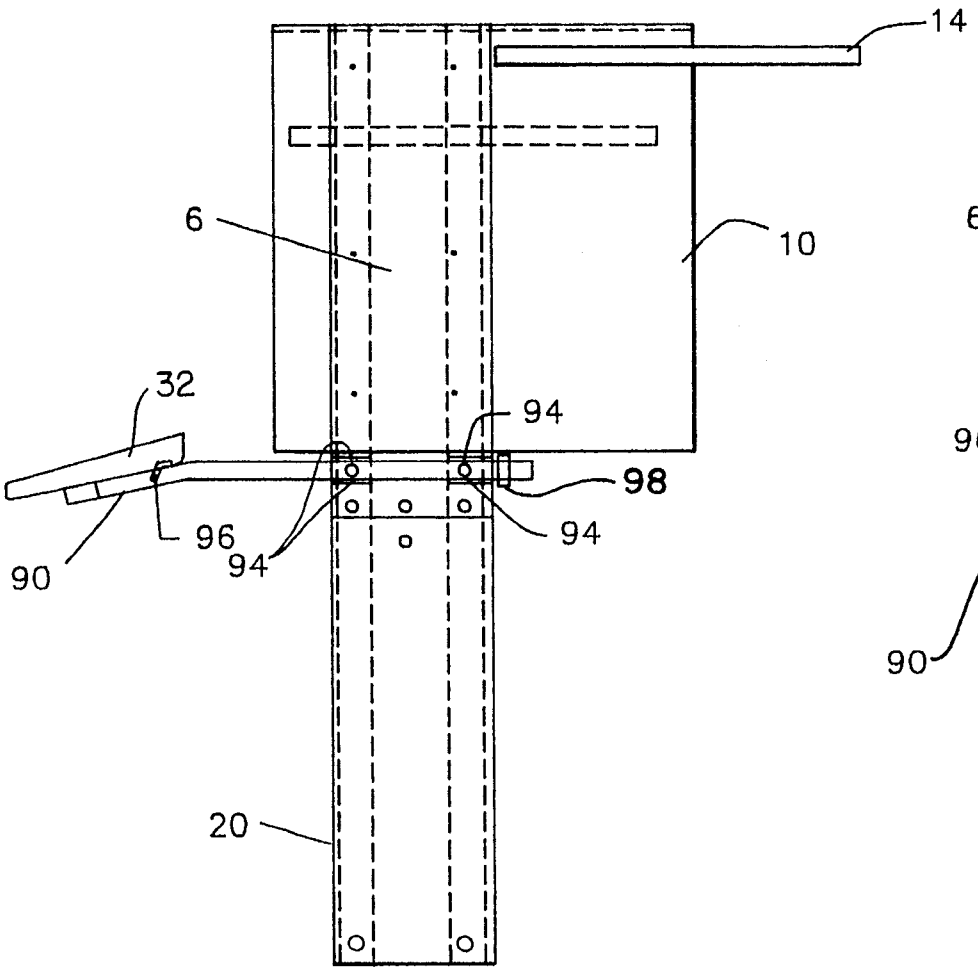

In the preferred embodiment, shown in FIGURES 13A and 13B the keyboard 32 is removably attached to the upper frame member 6 and stored in a pocket 92 on the interior of the back cover of the module 10 when not in use, as described below. Means of attachment of the keyboard 32 for use can be any known means, however, preferred is a support frame 90, having a wire form structure 96 to engage the feet on the keyboard 32 which slides in and out under the component module 10 on the upper member 6, on nylon bushing 94. A stop member 98 limits extension of the support frame 90 when in its fully extended position.

The upper frame member 6 can employ any means to support the components desired for use with the transportable stand 2, including shelves, a rack-type system, side mounts, etc.

In any event, the lowest point of attachment of the components or component module 10 to the upper frame member 6 cannot be below the point on the upper frame member sides 20 where the lower frame member sides 18 rise to when the upper frame member 6 is in its lowest position. This is necessary to assure that the upper frame member 6 can be moved into its lowest position without interference.

The module 10 includes support means for a monitor 30 to be placed on/or attached thereto. Said support means can be tilted to the appropriate angle by the use of levers 28 which engage the support means. This arrangement allows the monitor 30 to be tilted or angled to the proper alignment for use by the individual user. The support means may be an assembly which allows the monitor 30 to be locked into set angles and require deliberate activation of a lever lock to change angle. This locking feature would immobilize the monitor 30 thereby facilitating touch inputs to the monitoring screen. The keyboard mounting means may also cooperate with the levered support means to provide a relatively constant relationship between the angle of the screen 30 and the keyboard 32 when the screen 30 is tilted.

Figure 12:
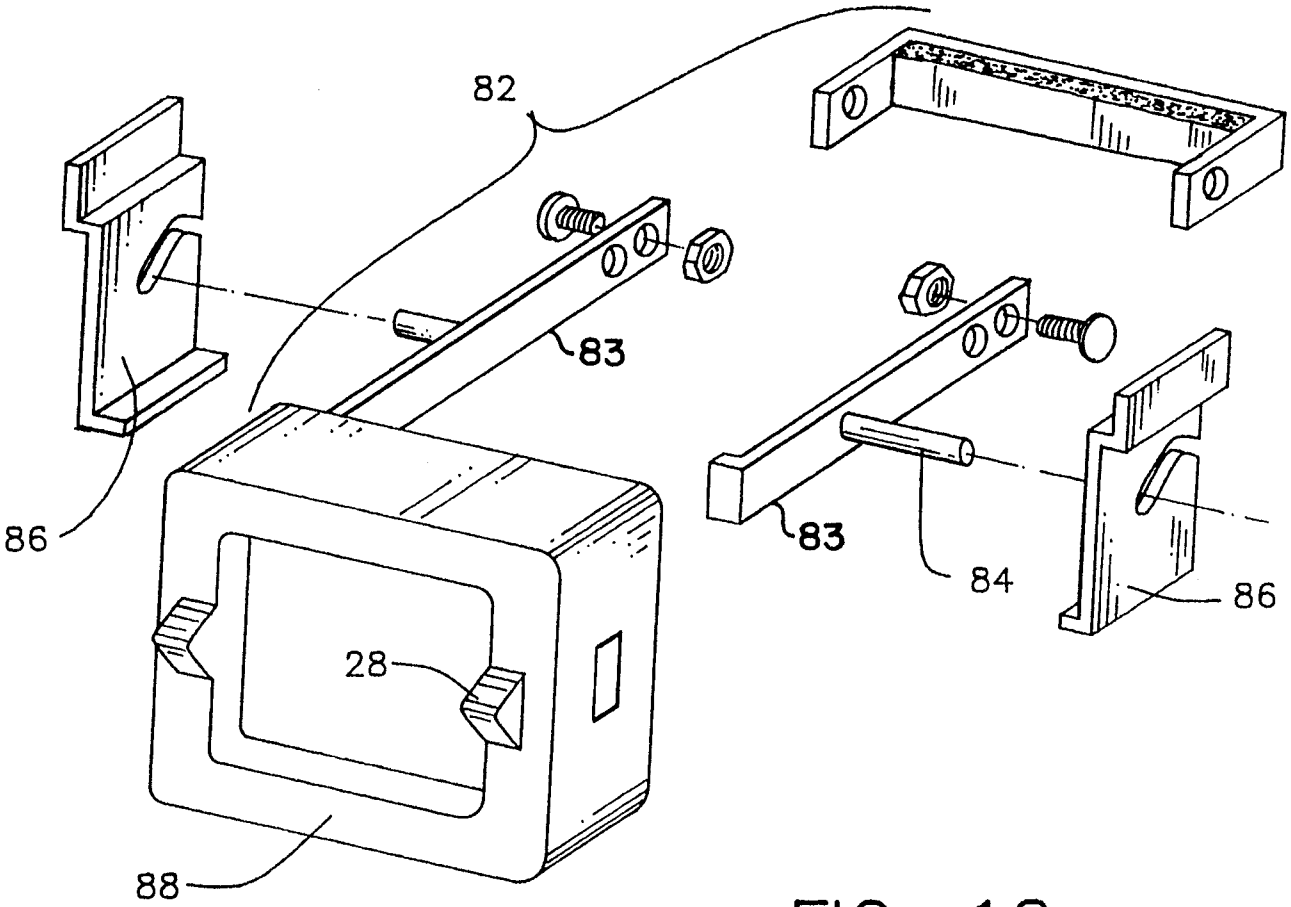
FIG. 12 is an exploded view of the preferred monitor adjustment means.

In the most preferred embodiment, the monitor support means includes an assembly 82 for engaging the monitor 30. The assembly 82, shown in FIG. 12, includes arms 83 having pivots 84 thereon which the monitor 30 is balanced. The pivots 84 engage a chassis bracket 86, welded to the inside of the component module 10, on each side of the monitor 30. The front of the assembly 82 comprises a bezel 88 to provide a finished look. Preferably, the assembly 82 includes foam cell padding on the portions contacting the monitor 30 to limit damage to the monitor 30.

An advantage of the component module 10 is the ability to close and lock the components therein, preventing theft or unauthorized use, through the use of a locking front cover 34 and a locking back cover 38. The locking front cover 34 attaches to the module 10, or sides of the upper frame member 6, to lock all or merely some of the components.

In the most preferred embodiment of FIGS. 8 and 9, the front cover 34 comprises a structural foam plastic panel having pivots at the upper outer edges which engage a pivot point on the component module 10 adjacent lateral rearward slots. The front cover 34 can be in a closed position, covering the components with an optional keyed cam lock at the bottom of the cover 34 which engages a slot on the component module 10 to prevent unauthorized access to the components. Also, the cover 34 can be pivoted to a horizontal position and slid horizontally rearwardly into an opening above the components on the slots adjacent the pivot of the cover 34, leaving the cover 34 in an open stowed position. The side edges of the cover 34 would preferably have ribs to engage the slots so that the cover is supported during rearward movement.

In the third position, the cover 34 can be pivoted over 180° from the closed position and tilted just beyond vertically into an open display position, secured by integrally molded detents to the compartment 10, so that the back of the cover 34 can be used as a stand for ballot information, etc. (see FIG. 8). The cover 34 can also have optional spaces for storing discs in integrally molded compartments or integrally molded means for holding an instruction or ballot card.

Figures 6A, 6B:
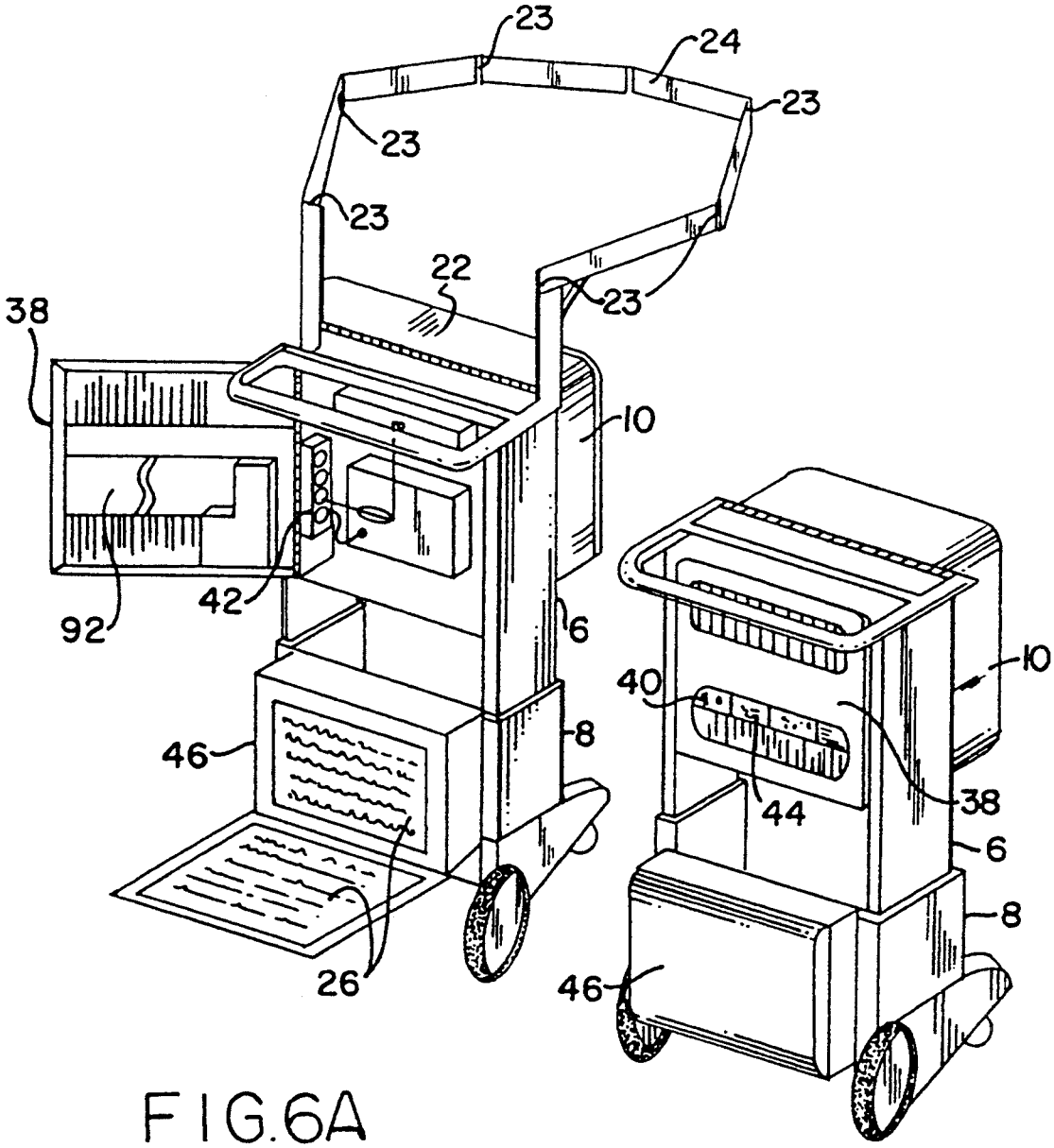
FIG. 6A is a perspective view of the back of the portable stand in the open configuration.
FIG. 6B is a perspective view of the back of the portable stand in the closed configuration.

The component module 10 is also preferred wherein the back of components contained therein are not exposed. As shown in FIGS. 6A–6B, a back cover 38 cooperates with the component module 10, or sides 20 of the upper frame member 6, to enclose the components. The back cover 38 preferably includes a power switch 40 to control power to an internal power outlet 42, to which the components are connected. A power cord compartment 44 contains the power cord to access a wall outlet, providing power to the components contained in the component module 10. Vents and a small electric fan are incorporated into the back cover 38 to control the operating temperature of the enclosed component module compartment.

The back cover 38 also contains a pocket 92 for holding a keyboard 32 when not in use. A slidable access panel in the outside surface of the back cover 38 allows access to a portion of the keyboard which may be used to reset computer components, etc. when used in a voting configuration, without the need to open the back cover 38. The back cover 38 includes locking means to prevent unauthorized access.

An advantage of a removable component module 10 is the ability to retain different component modules 10 having different components for different applications, being interchangeable in the frame 4. For example, in a school used as a polling place, the same frame 4 can be used with computer educational modules for student's use which are replaceable with voting modules for elections. Each module 10 would be closable and self-contained for storage purposes.

Figure 2:
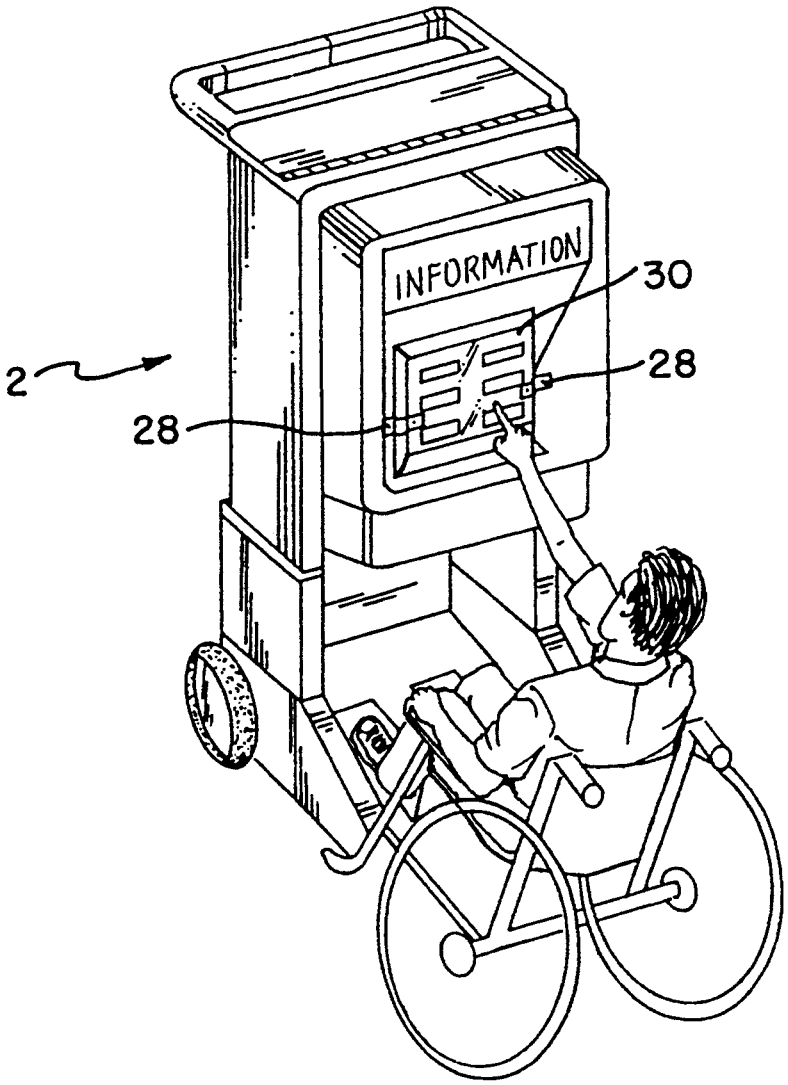
FIG. 2 is a perspective view of the stand used as an information kiosk.
Figure 4:
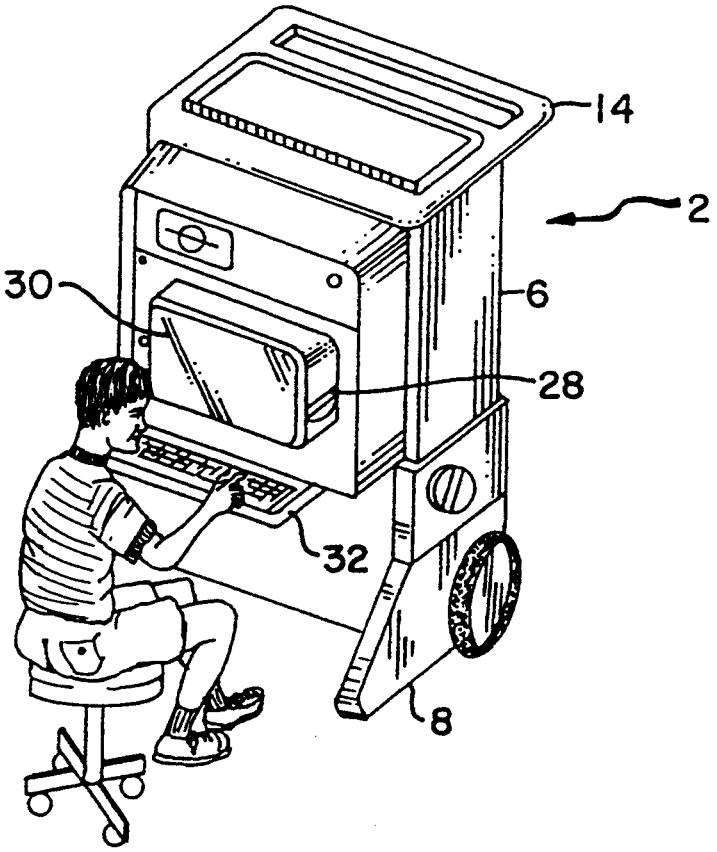
FIG. 4 is a perspective view of the stand being used as a portable child education station in the low position.
Figure 5:
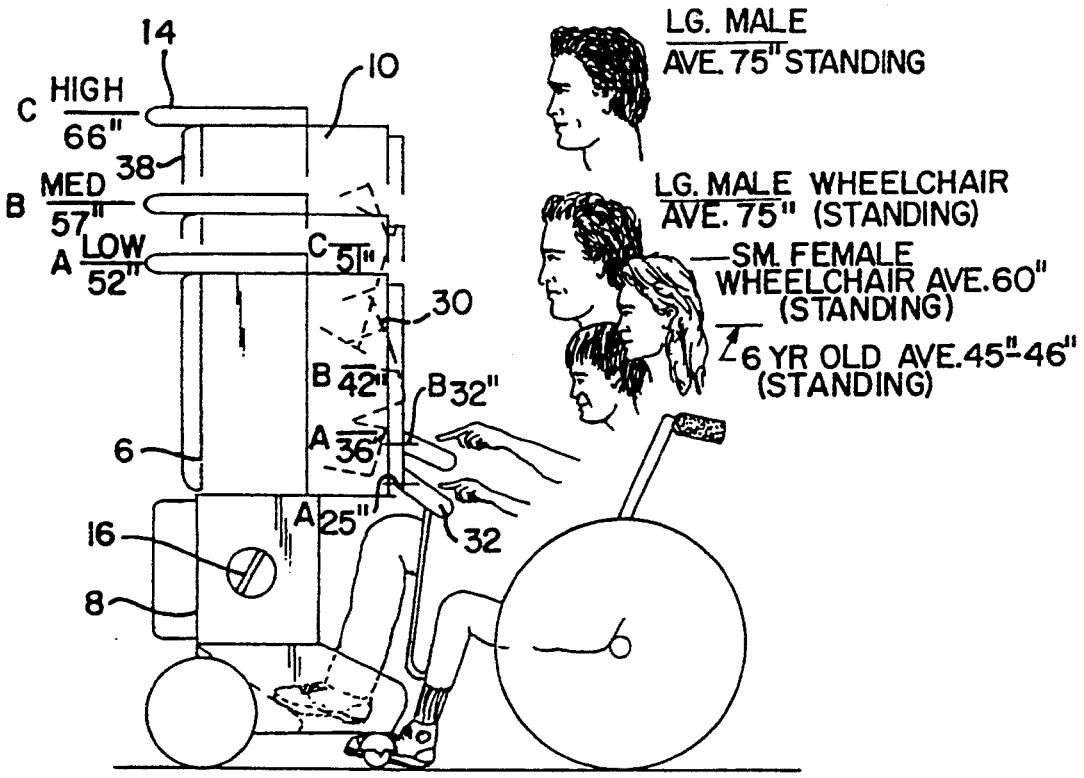
FIG. 5 is a side elevational view of the stand at its variable low, medium and high positions.

As shown in FIG. 5, the height of the upper frame member 6 is adjustable for a low position through to a high position, depending on the desired use, by rotation of a crank 16 which cooperates with a ratchet or gear train or activation of electric motor 60. When used with children's educational components (shown in FIG. 4), the stand 2 is in its low configuration, designated as "A" in FIG. 5 and being approximately 52" from the floor to the top of the upper frame member 6. When used as an information kiosk, shown in FIG. 2, the stand 2 can be in its medium configuration, designated as "B" and being approximately 57" to allow use by sitting adults or persons seated in wheelchairs. The high position, designated as "C" and being approximately 66" from the floor to the top of the upper frame member 6, can be used for a voting booth or the like when standing adults are contemplated utilizing the components.

The mean height of the components on the stand is generally about 15–18 inches below the height of the top of the upper frame member 6. The tilting means actuated by the levers 28, described above, provide for adjustment of the angle of the screen 30 to the specific height of the user.

Another closable compartment 46, shown in FIGS. 6A and 6B, can optionally be included on a cross member 52 on the back of the lower frame member 8 to provide additional storage. Shown in FIGS. 6A and 6B, the compartment 46 contains the privacy curtains 26 employed when the stand 2 is adapted for use as a voting booth. As shown in FIG. 9, the compartment 46 can be used to store a back-up battery source, preferably one or two 12 V batteries such as the UNION BATTERY pw121000 with 100AH nominal capacity for the components and/or height adjustment motor 60. Alternatively, if battery back-up is not needed in the voting booth configuration, the compartment can be lockable with a slot therein to serve as a ballot box.

When battery back-up is stored in compartment 46, a transformer may also be located therein. Vent openings, preferably associated with an electric fan, are contemplated in the sides and/or top of the compartment to dissipate heat from the transformer when in use.

Obvious variations of the above-identified invention will make themselves apparent to those of ordinary skill in the art. All such variations are intended to fall within the spirit and scope of the present invention, limited only by the appended claims.

I claim:

1. A transportable stand comprising two interactive frame members, an upper frame member and a lower frame member, wherein the upper frame member has mounted thereon components for user interaction, said upper frame member being adapted to be selectively raised and lowered on the lower frame member by means for varying component height comprising an electric motor which cooperates with a threaded shaft, and means for enabling movement of the stand comprising wheels attached to the lower frame member, said stand further comprising a three position front cover for enclosing at least one of the components pivotable between a closed position, an open stowed position and an open display position.

2. The transportable stand of claim 1 further comprising a lock associated with the front cover for limiting access to the components thereunder.

3. The transportable stand of claim 1 further comprising a back cover to limit access to the back of at least one of the components.

4. The transportable stand of claim 3 wherein the back cover includes a power supply cord and power switch.

5. The transportable stand of claim 3 wherein the back cover includes means to store a keyboard.

6. The transportable stand of claim 3 wherein the back cover is lockable to prohibit unauthorized access.

7. The transportable component stand of claim 1 further comprising means to releasably attach a keyboard onto the upper frame member which can be moved from a stored position to a use position.

8. The transportable stand of claim 1 further comprising handle means associated with the upper frame member to increase maneuverability of the stand.

9. The transportable stand of claim 1 further comprising curtain support structure means on which a privacy curtain can be hung to provide privacy to the user of the components.

10. The transportable stand of claim 1 wherein the mean height of the components can be varied from about 36" to about 60".

11. The transportabide stand of claim 1 further comprising a closeable storage compartment associated with the upper frame member.

12. The transportable stand of claim 1 further comprising a closeable storage compartment associated with the lower frame member.

13. The transportable stand of claim 12 further comprising a battery back-up for the components on the stand within the closable storage compartment.

14. The transportable stand of claim 1 wherein the means for varying component height further comprises a gear reduction box associated with the electric motor and threaded shaft and a nut actuator which engages the threaded shaft.

15. The transportable stand of claim 14 wherein the electric motor, gear reduction box and threaded shaft engage the upper frame member and the nut actuator engages the lower frame member, wherein when the upper frame member is raised the shaft is rotated against the actuator to push the upper frame member upwardly against the actuator on the-lower frame member.

16. The transportable stand of claim 1 wherein the upper frame member comprises male vertical side members which are insertable into female vertical side members of the lower frame member, and ride therein, to provide support and guidance for the upper frame member.

17. The transportable stand of claim 16 further comprising slide bearings associated with said male and female vertical side members to facilitate sliding interaction.

* * * * *